US009386837B2

(12) United States Patent
Geva et al.

(10) Patent No.: US 9,386,837 B2
(45) Date of Patent: Jul. 12, 2016

(54) MULTI-APPLICATION SKIN CARE SYSTEM

(75) Inventors: Ziv Geva, Rehovot (IL); Ofer Leizerovich, Nes-Ziona (IL); Ayelet Mofar, Nes-Ziona (IL)

(73) Assignee: SYNOIA TECHNOLOGIES LTD., Nes-Ziona (IL)

( * ) Notice: Subject to any disclaimer, the term of this patent is extended or adjusted under 35 U.S.C. 154(b) by 1465 days.

(21) Appl. No.: 12/608,151

(22) Filed: Oct. 29, 2009

(65) Prior Publication Data

US 2011/0106067 A1 May 5, 2011

(51) Int. Cl.

| | |
|---|---|
| ***A45D 40/00*** | (2006.01) |
| ***A45D 34/04*** | (2006.01) |
| ***A45D 40/18*** | (2006.01) |

(52) U.S. Cl.

CPC ..... *A45D 34/042* (2013.01); *A45D 40/18* (2013.01); *A45D 2200/1054* (2013.01); *A45D 2200/207* (2013.01)

(58) Field of Classification Search

None

See application file for complete search history.

(56) References Cited

U.S. PATENT DOCUMENTS

| | | | | |
|---|---|---|---|---|
| 6,066,153 | A * | 5/2000 | Lev | 606/180 |
| 2007/0135756 | A1* | 6/2007 | Kohlbrenner et al. | 604/21 |
| 2008/0014011 | A1* | 1/2008 | Rossen | 401/195 |
| 2008/0021438 | A1* | 1/2008 | Dacquay et al. | 604/521 |
| 2008/0058783 | A1* | 3/2008 | Altshuler et al. | 606/9 |
| 2008/0116847 | A1* | 5/2008 | Loke et al. | 320/108 |

* cited by examiner

*Primary Examiner* — Lynsey Crandalla

(74) *Attorney, Agent, or Firm* — Browdy and Neimark, PLLC

(57) ABSTRACT

A skin care device comprising a handle and swappable heads connected via a magnetic drive. Avoidance of a mechanical coupling between the handle and the head enhances safety. The magnetic power is converted to electrical power to operate the LEDs and anything else needing electrical power as well as mechanical forces releasing therapeutic cream upon the consumer's skin. The device may further apply RF to the skin for complementary treatment. Using the magnetic drives allows the transfer of power without using serrated gears and because there are no electrical connectors allows using swappable heads on the same handle in humid or wet conditions. The handle is charged inductively.

11 Claims, 9 Drawing Sheets

MULTI-APPLICATION SKIN CARE SYSTEM

BACKGROUND

1. Technical Field

The present invention relates to the field of skin treatment, and more particularly, to a device using swappable treatment heads and one time use dispensers that releases therapeutic cream onto the skin.

2. Discussion of Related Art

Various treatments, ointments and substances are used to treat skin.

BRIEF SUMMARY

Embodiments of the present invention provide a multi-application skin care system comprising a handle and a head. The handle comprises a power source; a user interface; and a base unit comprising a top surface and a motor that is electrically connected to the power source and is arranged to transmit power to the top surface. The head is watertight and detachably connected to the top surface of the base unit, and comprises: a disposable dispenser comprising a basis, therapeutic cream and a perforated sponge molded upon the basis such as to enclose the therapeutic cream; and a permanent part comprising a transmission arranged to transmit power from the top surface of the base unit to the basis of the disposable dispenser. The disposable dispenser is arranged to release a specified portion of the therapeutic cream through the sponge perforations onto a user's skin upon receiving the power transmitted to the basis.

Accordingly, according to an aspect of the present invention, there is provided a skin care device of, wherein the permanent part of the head further comprises a treatment unit arranged to apply a specified treatment onto the user's skin. Examples for treatment units are unit that apply RF radiation or other electromagnetic radiation such as visible light. In embodiments, the treatment unit comprises a radiation source, wherein the top surface comprises a magnetic projection with an eccentric mass that is connected to the motor and is arranged to rotate, wherein the transmission comprises a ring shaped stator positioned such that the magnetic projection rotates therewithin such as to induce a fluctuating current in the radiation source, and wherein the radiation source is arranged to radiate electromagnetic radiation with specified characteristics upon activation by the fluctuating current.

Accordingly, according to another aspect of the present invention, there is provided a skin care device, wherein the top surface comprises a projection that is connected to the motor and is arranged to rotate, wherein the transmission is arranged to transmit the rotations of the projection such as to periodically press the basis of the disposable dispenser, and wherein basis is arranged to release the specified portion of the therapeutic cream through the sponge perforations onto a user's skin upon being pressed by the transmission.

Accordingly, according to still another aspect of the present invention, there is provided a skin care device, wherein the power source is arranged to be inductively charged by a docking station.

Accordingly, according to yet another aspect of the present invention, there is provided a skin care device, wherein the handle comprises a transceiver and the head comprise an RFID with information relating to the therapeutic cream and head characteristics, and wherein the handle is arranged to read the RFID and present the information therefrom on the user interface.

These, additional, and/or other aspects and/or advantages of the present invention are: set forth in the detailed description which follows; possibly inferable from the detailed description; and/or learnable by practice of the present invention.

BRIEF DESCRIPTION OF THE DRAWINGS

The present invention will be more readily understood from the detailed description of embodiments thereof made in conjunction with the accompanying drawings of which.

DETAILED DESCRIPTION

Figure 2:
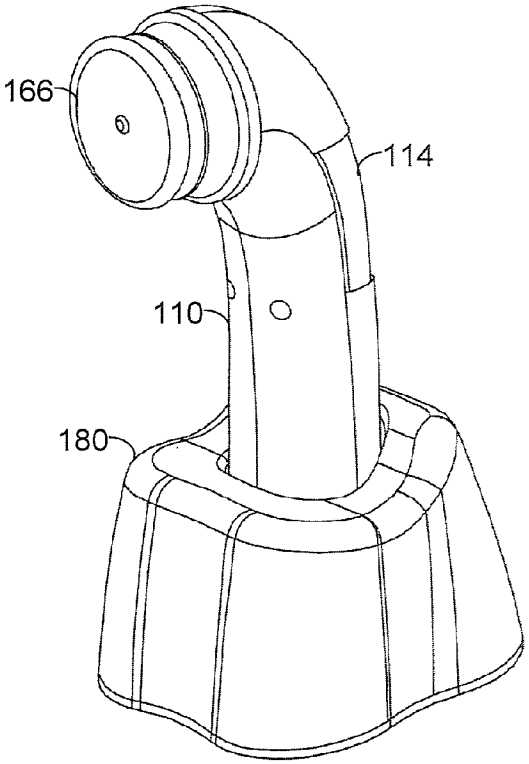
FIGS. 1, 2, 3 and 4 are overview illustrations of a skin care device, according to some embodiments of the invention.

Before explaining at least one embodiment of the invention in detail, it is to be understood that the invention is not limited in its application to the details of construction and the arrangement of the components set forth in the following description or illustrated in the drawings. The invention is applicable to other embodiments or of being practiced or carried out in various ways. Also, it is to be understood that the phraseology and terminology employed herein is for the purpose of description and should not be regarded as limiting.

Figure 1:
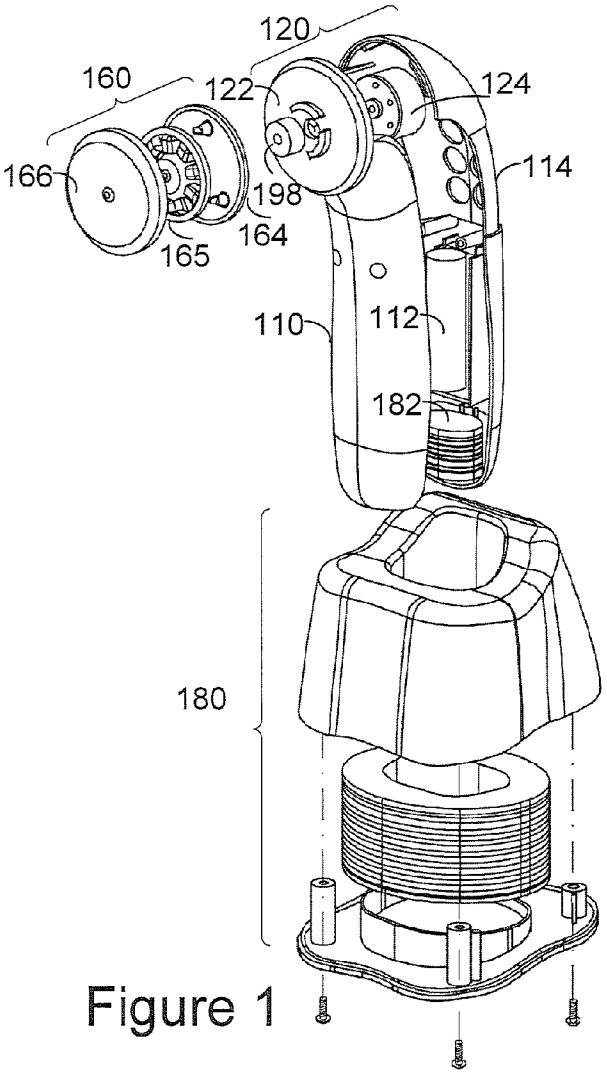
Figure 3:
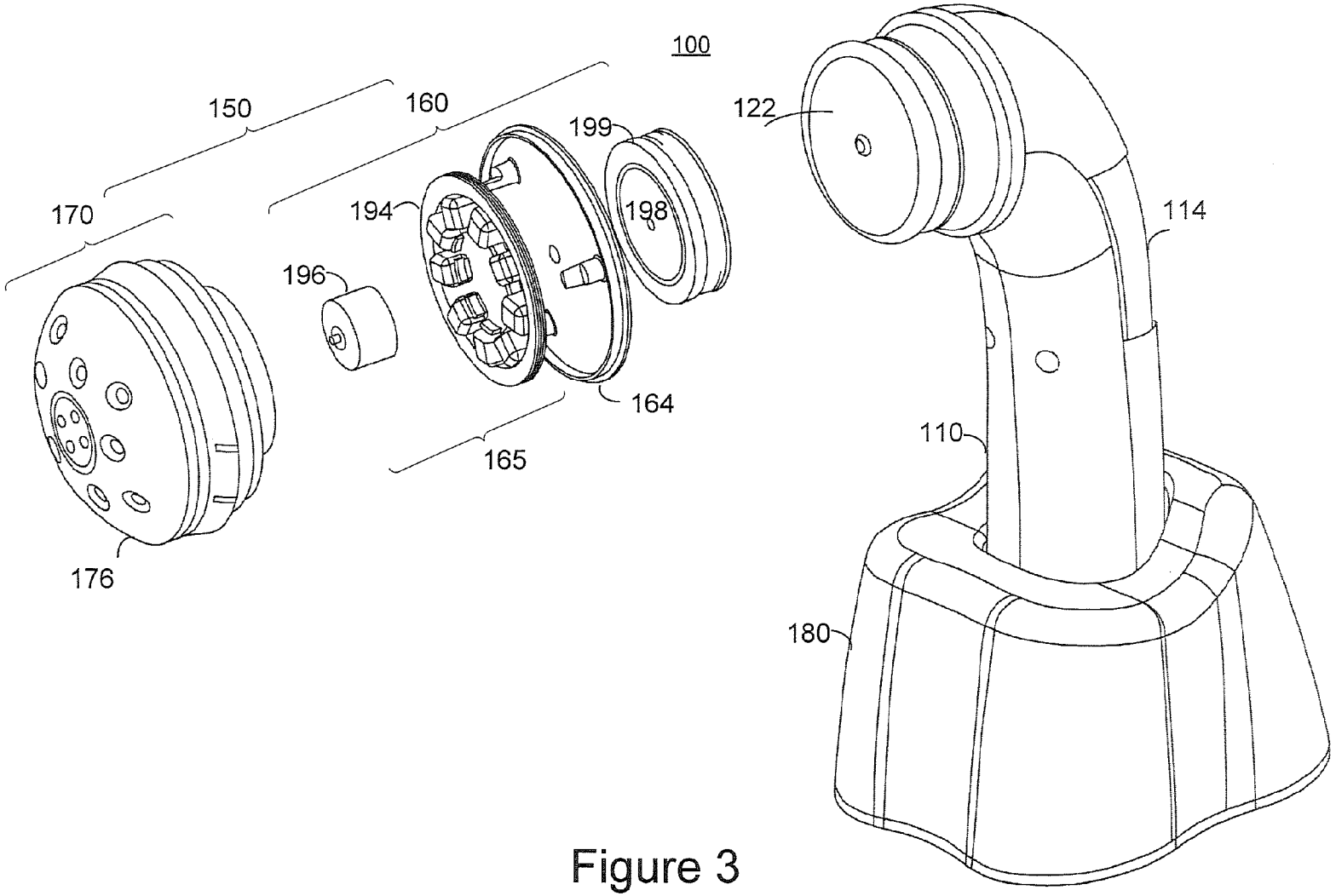
Figure 4:
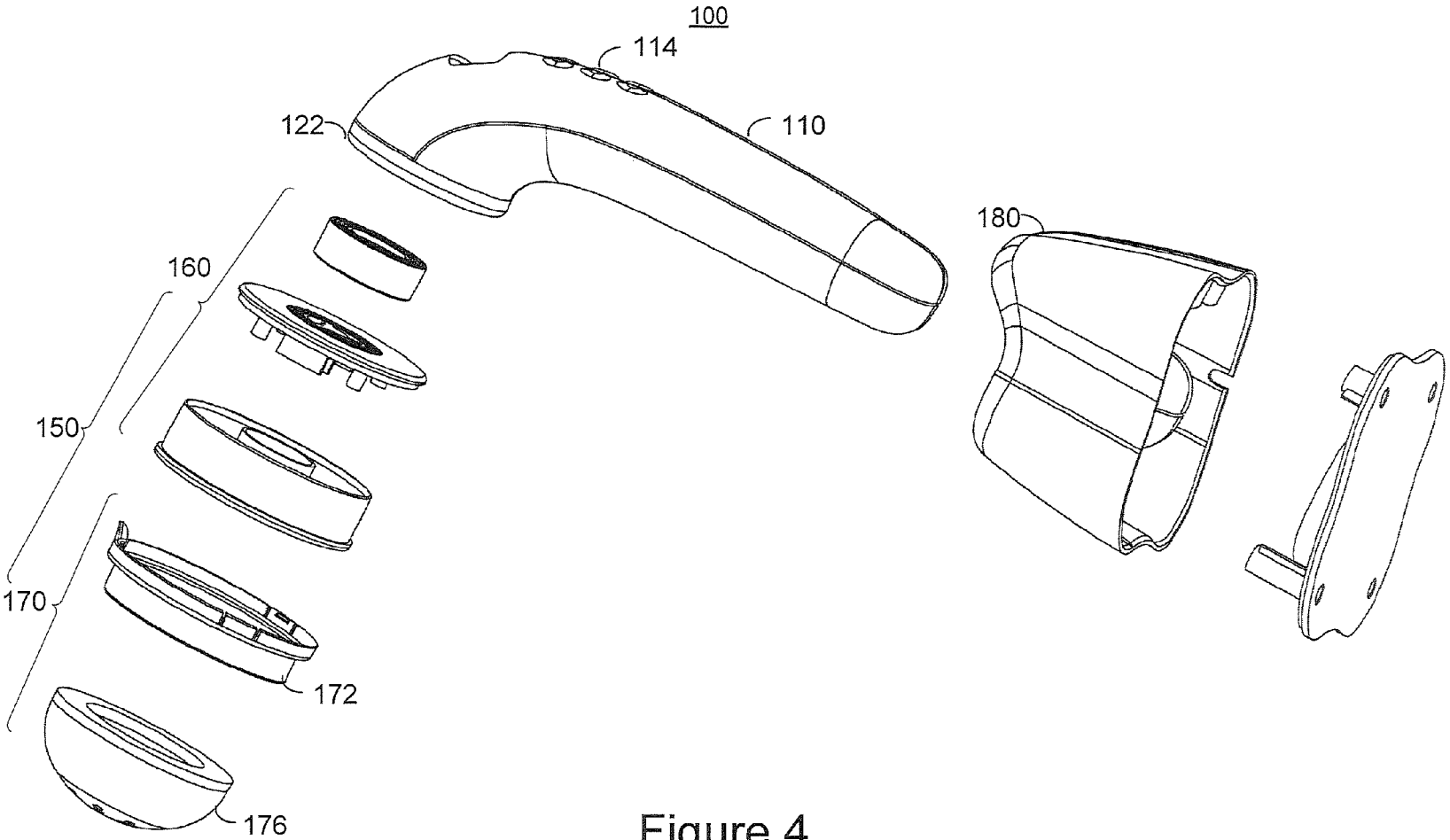
Figure 8:
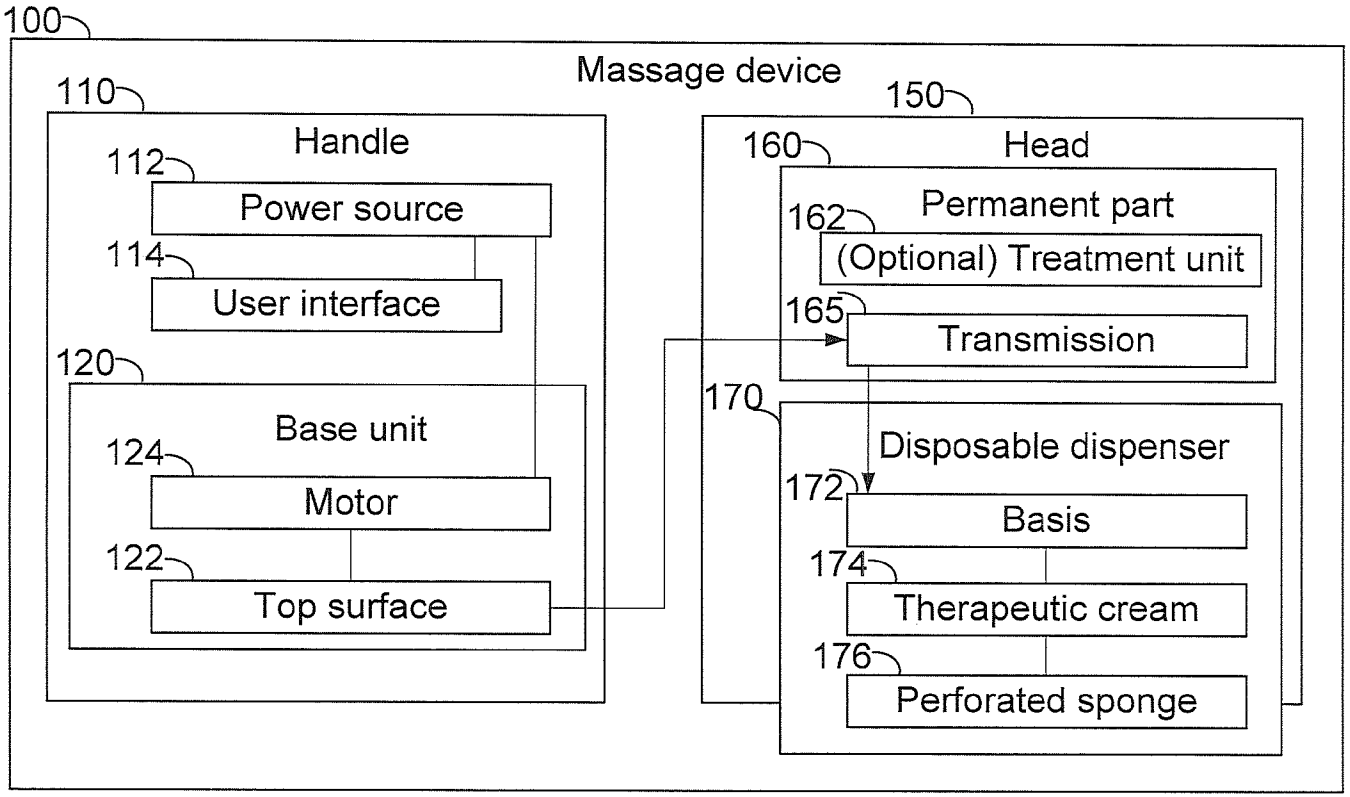
FIG. 8 is a schematic block diagram illustrating the skin care device, according to some embodiments of the invention.

FIGS. 1, 2, 3 and 4 are overview illustrations of a skin care device 100, according to some embodiments of the invention. FIGS. 1, 3 and 4 are exploded views of various configurations, FIGS. 1 and 2 illustrate skin care device 100 with a disposable dispenser 170 removed. FIG. 8 is a schematic block diagram illustrating skin care device 100, according to some embodiments of the invention.

Skin care device 100 comprises a handle 110 comprising a power source 112; a user interface 114; and a base unit 120 comprising a top surface 122 and a motor 124 that is electrically connected to power source 112 and is arranged to transmit power to top surface 122. Skin care device 100 further comprises a head 150, watertight and detachably connected to top surface 122 of base unit 120, comprising: a disposable dispenser 170 comprising a basis 172, therapeutic cream 174 and a perforated sponge 176 molded upon basis 172 such as to enclose therapeutic cream 174; and a permanent part 160 comprising a transmission 165 arranged to transmit power from top surface 122 of base unit 120 to basis 172 of disposable dispenser 170 (schematically represented by the arrows in FIG. 8), by connecting a base surface 164 of permanent part 160, which receiving power from top surface 122, with a top surface 166 of permanent part 160, which delivers power to basis 172, mechanically, inductively, electrically or magnetically. E.g., top surface 122 may comprise an eccentric and rotating magnet 196 mounted on a base 198 and rotating within a ring shaped stator 194 as a power delivery element. Base 198 may be enveloped by an adjustable rubber fitting 199. Disposable dispenser 170 is arranged to release a specified portion of therapeutic cream 174 through sponge perforations 177 onto a user's skin upon receiving the power transmitted to basis 172.

Heads 150 are swappable, various heads 150 may be used for various treatments. Heads 150 may be slipped onto handle 110. Various disposable dispenser 170, each with therapeutic cream 174 that may be specially formulated for each treatment, may be clipped onto head 150.

Transmission 165 may receive power from base unit 120 via magnetic forces and without any mechanical gear. This method of power transferal allows sealing handle 110 and head 150.

According to some embodiments of the invention, a color coding system may be used to match heads 150 with disposable dispensers 170. Some disposable dispensers 170 may be used with more than one head 150.

According to some embodiments of the invention, power source 112 may be charged inductively from a docking station 180 utilizing an induction charger transformer 182 receiving induction from a transformer in docking station 180.

According to some embodiments of the invention, permanent part 160 of head 150 further comprises a treatment unit 162 arranged to apply a specified treatment onto the user's skin, e.g. treatment with RF—radiofrequency radiation, or LEDs—light emitting diodes.

According to some embodiments of the invention, permanent part 160 may be connected to base unit 120 and be a part of handle 110. In some embodiments handle 110 supplies both power and motion, as well as optionally treatment via treatment unit 162.

According to some embodiments of the invention, head 150 may comprise an autonomous power source (not shown) that may be charged inductively and supply energy to disposable dispenser 170.

Figure 5A:
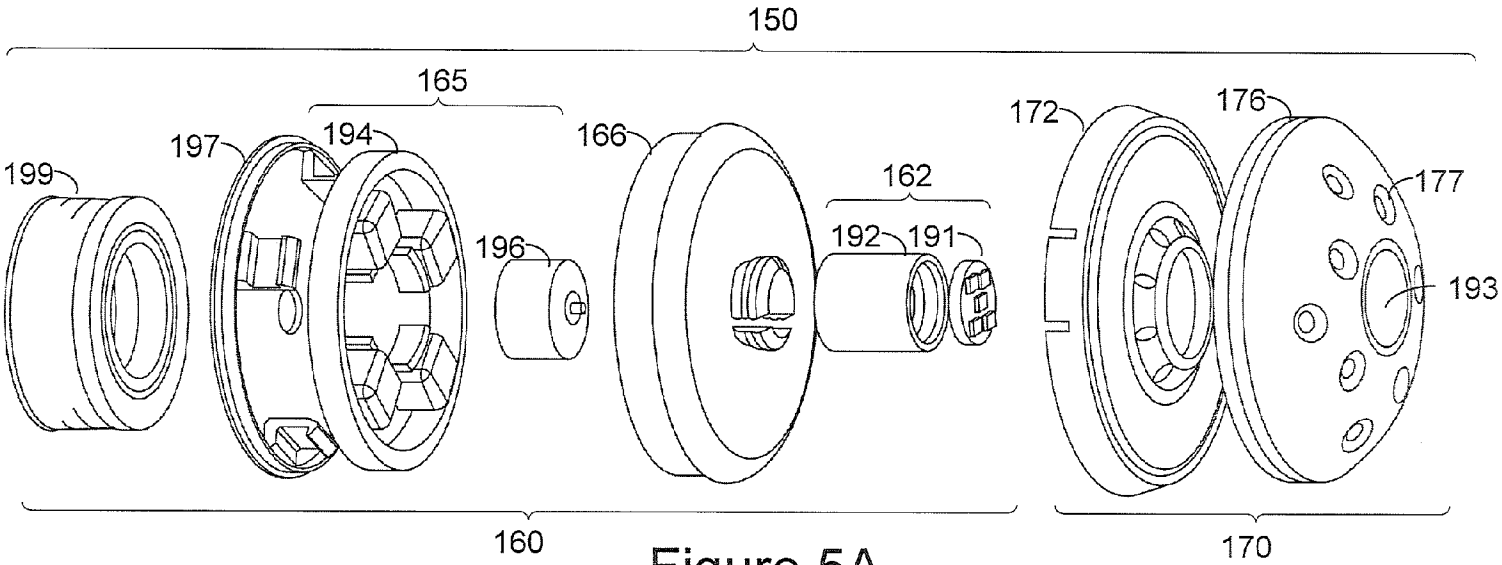
FIGS. 5A, 5B and 5C are illustrations of a head of the skin care device with a treating unit comprising an RF transmitter, according to some embodiments of the invention.
Figure 5C:
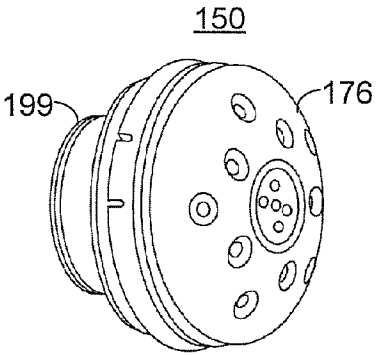
Figure 5B:
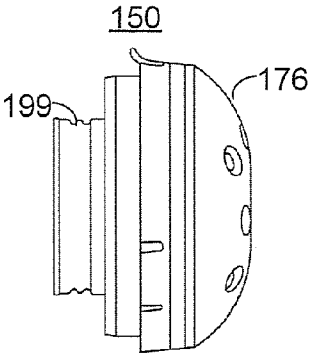

FIGS. 5A, 5B and 5C are illustrations of head 150 of skin care device 100 with a treating unit 162 comprising an RF transmitter 191, according to some embodiments of the invention. FIG. 5A is an exploded view, FIG. 5B a side view and FIG. 5C is a perspective view.

According to some embodiments of the invention, treatment unit 162 may comprises RF unit 191 and optionally a plurality of filaments (not shown) connected thereto and going through perforated sponge 176. Treatment unit 162 is arranged to warm the skin by transmitting RF electromagnetic radiation with specified specifications thereto. In embodiments, energy supply to RF unit 191 may be carried out by exploiting induction from rotating magnet 196 mounted on base 198 and rotating within ring shaped stator 194.

Figure 6A:
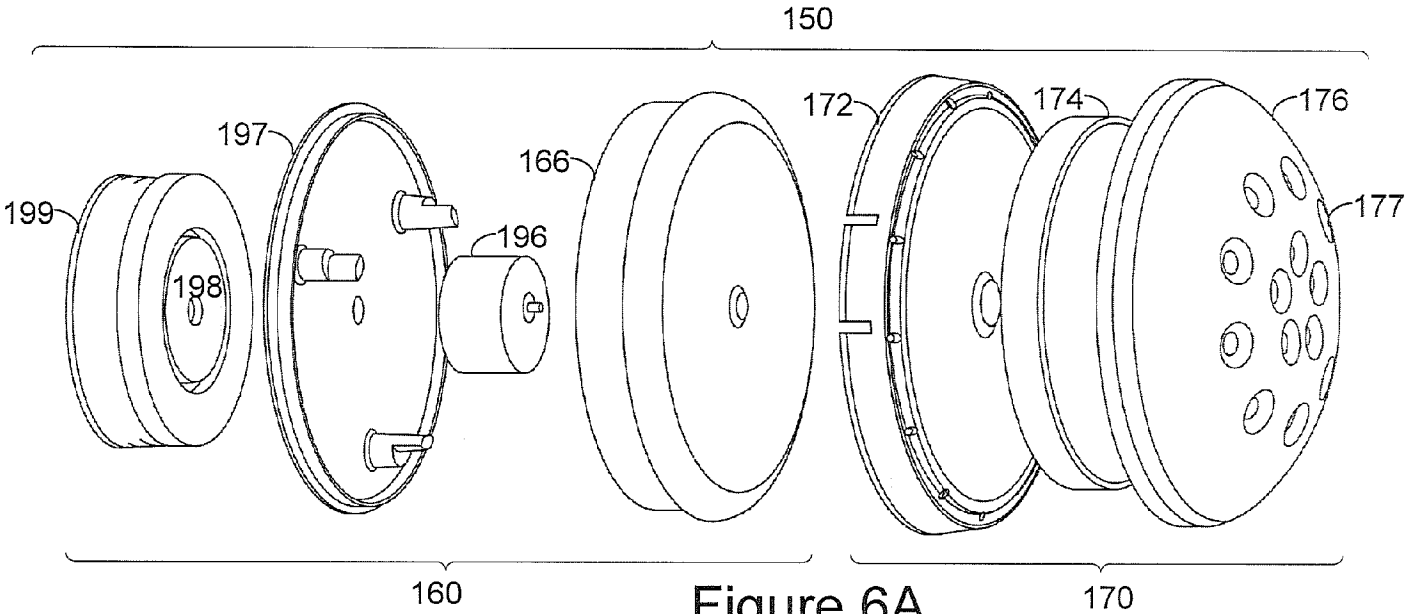
FIGS. 6A, 6B and 6C are illustrations of a head of the skin care device, according to some embodiments of the invention.
Figure 6C:
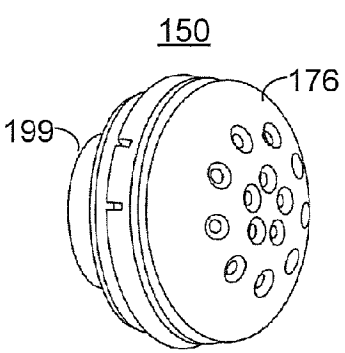
Figure 6B:
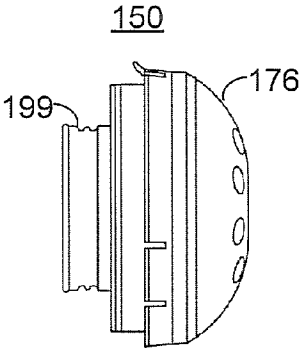

FIGS. 6A, 6B and 6C are illustrations of head 150 of skin care device 100, according to some embodiments of the invention. FIG. 6A is an exploded view, FIG. 6B a side view and FIG. 6C is a perspective view. Rotating magnet 196 mounted on base 198 and rotating within ring shaped stator 194 may be utilized to generate power, that is further used to mechanically push basis 172 such that the specified portion of therapeutic cream 174 is released through sponge perforations 177 onto a user's skin.

Figure 7A:
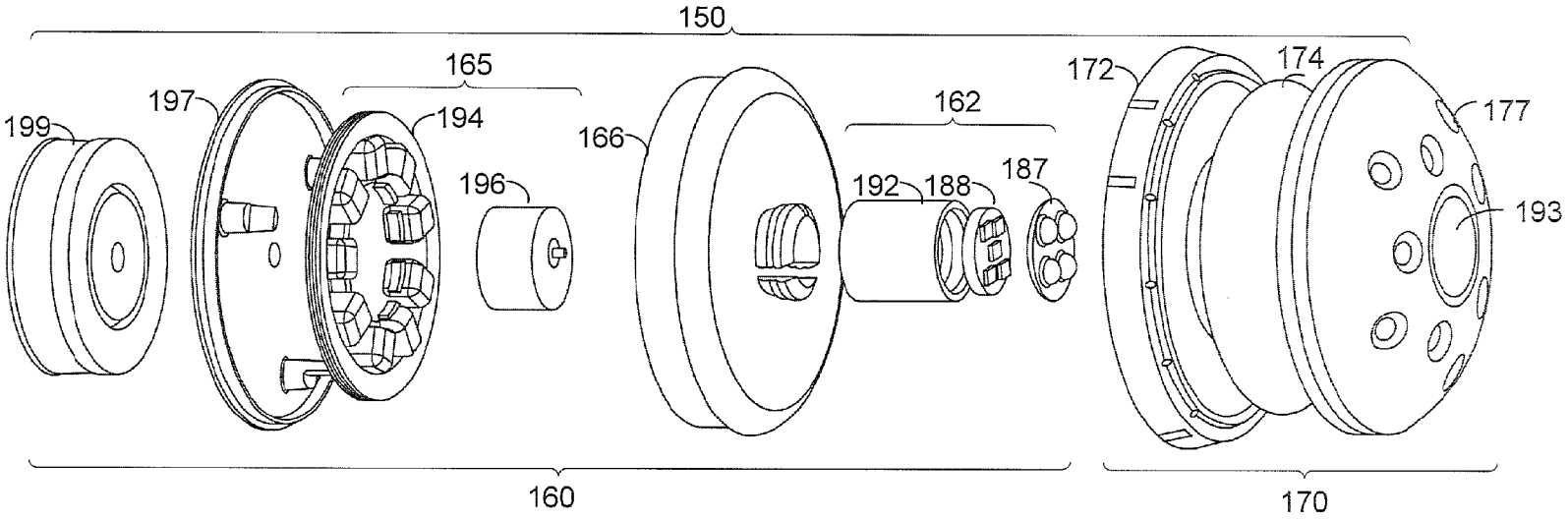
FIGS. 7A, 7B and 7C are illustrations of a head of the skin care device with a treating unit comprising LEDs, according to some embodiments of the invention.
Figure 7C:
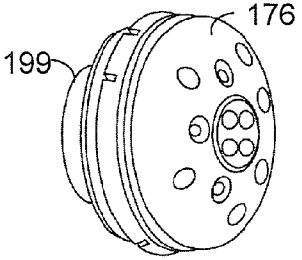
Figure 7B:
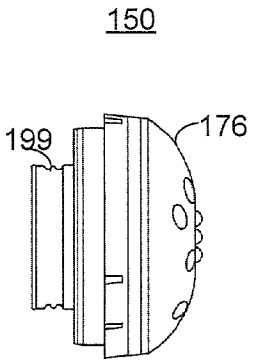

FIGS. 7A, 7B and 7C are illustrations of head 150 of skin care device 100 with a treating unit 162 comprising LEDs 188, according to some embodiments of the invention. FIG. 7A is an exploded view, FIG. 7B a side view and FIG. 7C is a perspective view. Treatment unit 162 may comprise a plurality of LEDs 188 arranged to extend from permanent part 160 through disposable dispenser 170 to a close proximity of the skin. Treatment unit 162 is arranged to warm the skin by illuminating it with LEDs 188. LEDs 188 (with an appropriate printed circuit board) may be used to treat the skin by applying warmth, or a specified wavelength range (e.g., blue light or ultraviolet) thereupon. LEDs 188 may be mounted on a projection 192 (e.g., a silicon tube) of permanent part 160 arranged to fit through a hole 193 in disposable dispenser 170 (e.g., sealably), such as to come to the close proximity of the skin. LEDs 188 may be covered by an optical element 187 such as a lens or an array of lenses to enhance the efficacy of the radiation from LEDs 188 in its application to the skin.

No wires are used to power head 150, LEDs 188 or other components. All power is transferred magnetically from handle 110 and transformed to mechanical or electric energy within head 150 (e.g., by transmission 165, by ring shaped stator 194).

According to some embodiments of the invention, treatment unit 162 may comprises a radiation source (e.g., LEDs 188 or RF transmitter 191), wherein top surface 122 comprises magnetic projection 196 with an eccentric mass that is connected to motor 124 and is arranged to rotate within ring shaped stator 194 of transmission 165, such as to induce a fluctuating current in the radiation source, generating thereby electromagnetic radiation with specified characteristics.

According to some embodiments of the invention, top surface 122 comprises projection 192 that is connected to motor 124 and is arranged to rotate, wherein transmission 165 is arranged to transmit the rotations of projection 192 such as to periodically press basis 172 of disposable dispenser 170 and thereby releases the specified portion of therapeutic cream 174 through sponge perforations 177 onto a user's skin upon being pressed by transmission 165.

According to some embodiments of the invention, head 150 may further comprise a propeller (not shown) that is arranged to release therapeutic cream 174 through sponge perforations 177 onto a user's skin upon being activated either mechanically by transmission 165 or induction from transmission 165 or handle 110.

According to some embodiments of the invention, magnetic fields and forces that are used to transfer power from handle 110 to head 150 may also be used to enhance the treatment of the skin, and adjusted accordingly.

According to some embodiments of the invention, all elements (head 150, permanent part 160, disposable dispenser 170, handle 110) are watertight when standing alone or when interconnected, and may be inductively charged such as to allow safe use under humid or wet conditions.

According to some embodiments of the invention, head 150 may further comprise sensors (not shown) arranged to measure characteristics of the user's skin and of applied treatment, such as to control the massage process automatically or upon user indications. Measurements and data may be presented, processed and selected via user interface 114.

Advantageously, skin care device 100 allows combining mechanical, electrical and warmth treatment, together with application of therapeutic cream 174 onto the user's skin, at any environment in a simple manner. Charging skin care device 100 inductively allows avoiding external sockets and wiring, thereby enhancing user safety.

Figure 9:
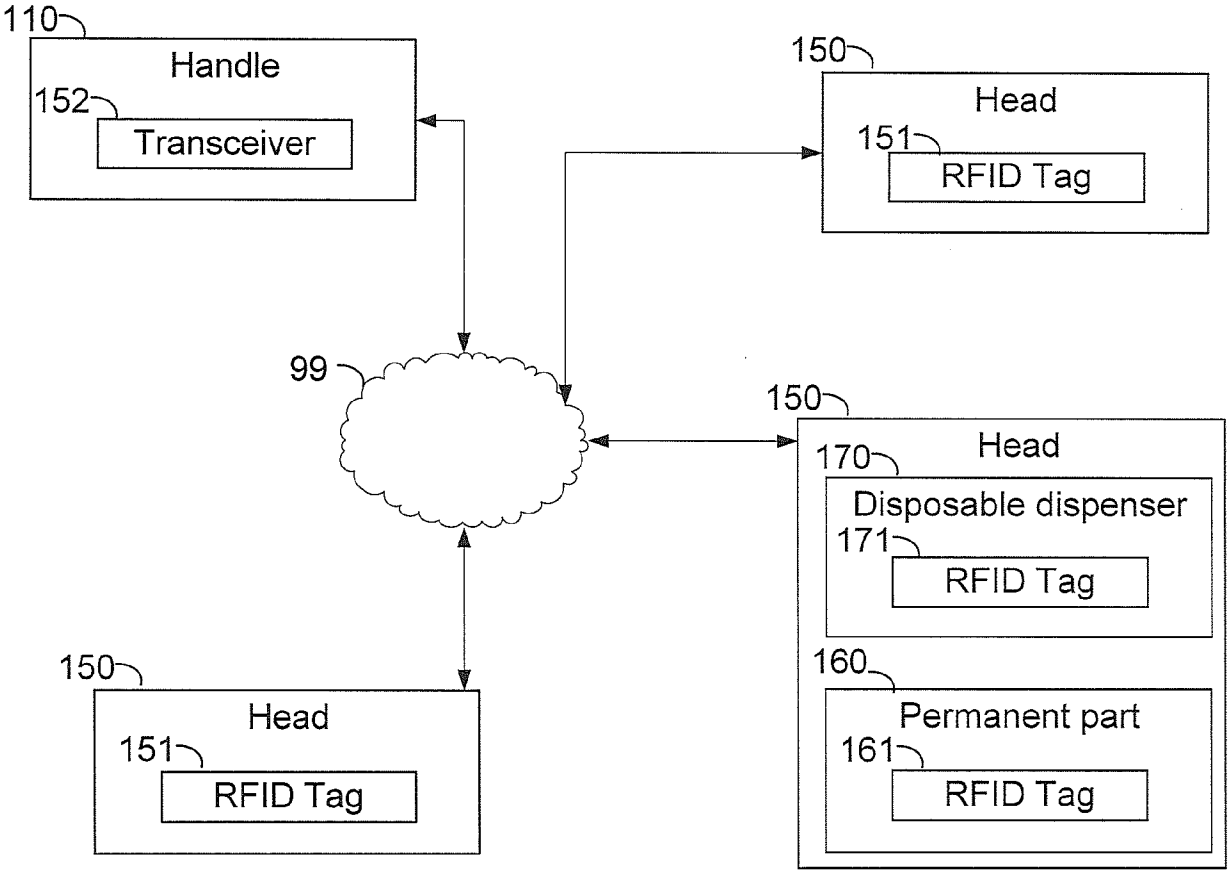
FIG. 9 is a schematic block diagram illustrating communication capabilities of the handle and the head, according to some embodiments of the invention.

FIG. 9 is a schematic block diagram illustrating communication capabilities of handle 110 and head 150, according to some embodiments of the invention. Handle 110 may comprise a transceiver 152, and head 150 may comprise an RFID tag 151 with information relating to therapeutic cream 174 and head characteristics. Handle 110 may be arranged to read RFID tags 151 (e.g., via a communication link 99) and present the information therefrom on user interface 114. According to some embodiments, disposable dispenser 170 may have an RFID tag 171 and permanent part 160 may have an RFID tag 161, such that handle 110 may distinguish among them, and allow the user to combine preferred power transmission (through permanent part 160) with a preferred therapeutic cream 174 (through disposable dispenser 170). RFID tags 171, 161, 151 may allow building and following long term treatment programs and instruct the user in relation to recommended swapping of heads 150. RFID tags 171, 161, 151 also ensure that only original heads 150 are used, thus enhancing safety.

According to some embodiments of the invention, skin care device 100 comprises handle 110 and head 150 which are connected via a magnetic drive. Avoidance of a mechanical coupling between handle 110 and head 150 allows sealing handle 110 and head 150 as well as enhances safety. The magnetic power is converted to mechanical forces releasing therapeutic cream 174 upon the consumer's skin. Device 100 may further apply RF to the skin for complementary treatment. Using the magnetic drives allows sealing handle 110 and heads 150 and thus allow using swappable heads 150 on the same handle 110 in humid conditions. Handle 110 may be charged inductively.

Figure 10B:
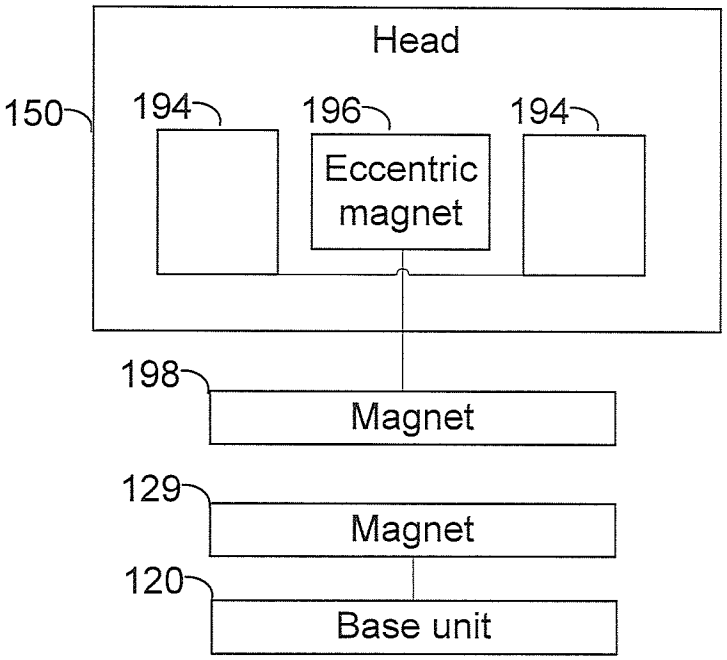
FIGS. 10A and 10B are highly schematic block diagrams illustrating power transfer in the skin care device, according to some embodiments of the invention.
Figure 10A:
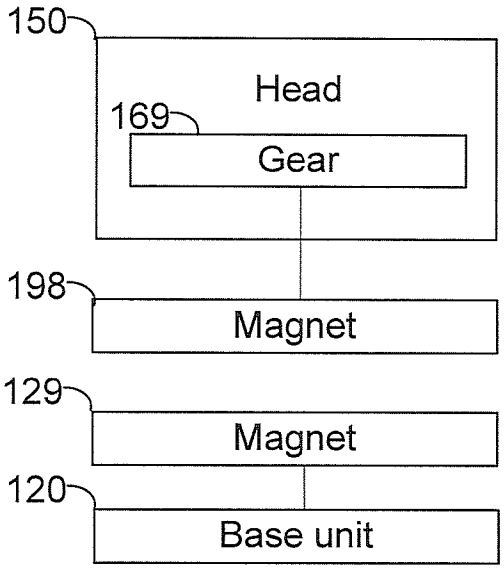

FIGS. 10A and 10B are highly schematic block diagrams illustrating power transfer in skin care device 100, according to some embodiments of the invention. Power transfer from base unit 120 to head 150 is carried out by magnetic forces from a magnet 129 in base unit 120 to magnet 198 in head 150. The magnetic forces may be transferred by rotating anisotropic magnet 129 (by motor 124) such as to rotate magnet 198. The use of magnetic power transfer allow avoiding wiring and sockets and thus enhance safety during use in humid environments. Magnet 198 is connected to transmission 165 that is arranged to use the transferred energy within head 150. For example, transmission 165 may comprise a gear 169 connected to rotating magnet 198 by a shaft (FIG. 10A). In another example, transmission 165 may comprise eccentric magnet 196 connected to magnet 198 via a shaft (FIG. 10B), and arranged to rotate within thin ring stator 194, generating thereby electric current by inductance, which may be further utilized as energy source in head 150.

The smart swappable head adaptors include RFID technology to create an interface with the intelligent controller housed in the base unit handle. For the sake of brevity it is called the swappable head.

The base unit handle or any of the swappable treatment heads do NOT have any external electrical connections and is therefore waterproof and perfectly safe against electrical shock hazards.

There are no rotating serrated gears or protrusions in the drive mechanism. The inter-unit drive is accomplished by rotating magnets.

Using a single base unit handle containing the battery power source the user can attach as many swappable treatment heads as there are treatments currently available, now or in the future. In other words, customers ONLY need to buy the new attachments when new treatments are added in the future.

As a consumer skin care product it is perfectly safe to operate in a wet environment or even submerged in water. It can be used without fear in the bath or shower.

Multiple technologies are used in all treatment sessions ensuring a faster and more effective treatment. This novel approach ensures affective treatment for a wider range of skin type, color and condition. This includes a combination of technologies such as: Rotating magnetic field; Skin massage; Near blue light; Vibration; RF; Therapeutic creams; Peeling/Dermabration using aluminum or diamond dust; Special segments of the population such as age and ethnicity are able to choose from a wide range of treatments that are available.

Products are clearly marked as conforming to BOTH the KASHRUT and HALAL laws so that both Jews and Moslems are able to use the WISH system without fear.

A computer is used to control the treatments, which means the following: WISH is able to recognize the correct head/dispenser combinations ensuring personal convenience and correct session sequences. RFID checks that the dispenser is also new.

When multiple sessions are performed the unit will greet the user in the morning with an audio and visual (Flashing LEDs) indication indicating that the next session of a multiple treatment is NOW due. This is made possible because the WISH system platform uses a real-time clock located in the base unit handle.

The display shows which swappable head and disposable dispenser to use.

Powering on the product automatically displays any future scheduled treatment. For example, EMS Treatment 3 of 6 is due in another 3 days. The user can do other treatments in between if allowed by the smart controller.

Electrical power is self generated in specific swappable heads when required, as there are no external wires or plugs connected to the battery source, in the product base handle. This is accomplished by using an eccentric shaped magnet that is rotated inside a ring shaped stator wound as an electrical generator. The locally generated power is used to power the head. As an example, the RF head, LEDs and others requiring power, use this type of generated power. This method of generating electrical power is also called: a simple low profile electrical generator with a thin stator.

Multiple different disposable massage dispensers containing therapeutic ointment or gel are clipped onto their matching swappable heads when required for treatment. Each swappable head can have multiple matching disposable clip-on dispensers. The on-board computer checks for a valid combination.

The RF (Radio Frequency) treatment uses a combination of an RF treatment head, used to penetrate the surface layers of the skin, together with a rotating dispenser head that massages the skin while the therapeutic ointment or gel is slowly released onto the skin. This already multi-technology treatment is enhanced by the rotating magnetic field created from the mechanical drive system.

A Micro-current treatment head is used to penetrate the sub dermal layer of the skin together with a rotating dispenser head that massages the skin while the therapeutic ointment or gel is slowly released onto the skin. This already multi-technology treatment is enhanced by the rotating magnetic field created from the mechanical drive system.

Because there are no power connections and the instrument is completely waterproof, the usual safety instructions or warnings do not apply and are NOT required for this product.

The computer memory is backed up using a dedicated rechargeable battery.

RFID technology is used to: Prevent the disposable dispensers from being used out of sequence when performing a multi-treatment series or refilled by unsupervised unknown $3^{rd}$ parties. The disposable dispensers clip onto the swappable head during treatment sessions. Once the session is completed the RFID tags them as used and they must be disposed of as they cannot be used again on ANY WISH system platform; Display an error message if the incorrect dispenser is placed on the currently installed swappable head; Transfer information in a wireless form from the swappable head to the smart controller in the base unit handle for displaying short instructions on using the product on the display screen. In other words, when a swappable head is installed onto the base unit handle, treatment information is displayed for that specific head; Keep track of multiple session treatments using the intelligent controller housed in the base unit handle. Treatment time for each session is displayed on the display screen. If the head requires multiple sessions the session number and its treatment duration is displayed together with how many sessions are required and their frequency. This means that some treatments could be spaced over many days or weeks and the information required to control multiple treatments is kept in the smart swappable head and/or the WISH computer system. This information is transferred using RFID technology whenever a swappable head is installed; Keep track of the treatments using a Real-time clock causing the beeper to sound and LEDs to flash when another treatment is due. Because the cosmetic aid is safe to handle it can be stored and on permanent charge in the user bathroom; Show on the display screen the correct combination of swappable head and disposable dispenser to use; Display part numbers on which dispensable heads and how many to order for future treatments when starting or ending a multi-session treatment; Inform the customer that the disposable dispenser is empty and must be disposed off; Inform the customer that the disposable dispenser must be replaced with another. The dispenser type is displayed on the screen; Ensure that the user cannot start the base unit handle drive mechanism without the correct swappable head and disposable dispenser combination installed.

One base unit handle uses multiple smart attached heads to treat the full range of known skin problems, now and in the future. This means that: The user only has to purchase new treatment kits when they become available; The user only has to purchase replacement kits before the user start a new treatment; The basic hand-held base unit handle is able to operate and control multiple heads, even when performing multiple multi-session treatments at the same time. A small display screen shows the status of the treatment as well as short procedural instructions and messages. The display shows the duration of the treatment and when it ends.

The internal batteries are recharged without requiring a power cable to connect the base unit handle to mains power, using an induction process half (primary winding) in the docking station and the other half (secondary winding) in the base unit handle to create an output voltage (via induction) in the base unit handle this is rectified using a simple bridge circuit to change the voltage into DC (Direct Current) to recharge the internal batteries. A REAL TIME clock is used as part of the smart controller in the base unit handle to keep track of scheduled or multiple session treatments.

The mechanical drive between the base unit handle and multiple different swappable heads is via rotating ROUND magnets. Since the mechanical drive uses ROUND magnets there are no serrated or sharp edges rotating in the base unit handle or swappable treatment heads. The rotating magnets create a rotating magnetic field that assists in the treatment process.

Swappable treatment heads and dispensers are color coded so that it is possible to see at a glance which dispensers can be used with each swappable head. When a swappable head and the correct dispenser are installed the treatment information is displayed on the screen, otherwise an error message is shown.

Vacuum is sometimes added to show the effectiveness of the treatment and remove dead skin.

A special swappable head containing industrial aluminum/diamond dust is used as an abrasive to peel the face.

In the above description, an embodiment is an example or implementation of the inventions. The various appearances of "one embodiment," "an embodiment" or "some embodiments" do not necessarily all refer to the same embodiments.

Although various features of the invention may be described in the context of a single embodiment, the features may also be provided separately or in any suitable combination. Conversely, although the invention may be described herein in the context of separate embodiments for clarity, the invention may also be implemented in a single embodiment.

Reference in the specification to "some embodiments", "an embodiment", "one embodiment" or "other embodiments" means that a particular feature, structure, or characteristic described in connection with the embodiments is included in at least some embodiments, but not necessarily all embodiments, of the inventions.

It is to be understood that the phraseology and terminology employed herein is not to be construed as limiting and are for descriptive purpose only.

The principles and uses of the teachings of the present invention may be better understood with reference to the accompanying description, figures and examples.

It is to be understood that the details set forth herein do not construe a limitation to an application of the invention.

Furthermore, it is to be understood that the invention can be carried out or practiced in various ways and that the invention can be implemented in embodiments other than the ones outlined in the description above.

It is to be understood that the terms "including", "comprising", "consisting" and grammatical variants thereof do not preclude the addition of one or more components, features, steps, or integers or groups thereof and that the terms are to be construed as specifying components, features, steps or integers.

If the specification or claims refer to "an additional" element, that does not preclude there being more than one of the additional element.

It is to be understood that where the claims or specification refer to "a" or "an" element, such reference is not be construed that there is only one of that element.

It is to be understood that where the specification states that a component, feature, structure, or characteristic "may", "might", "can" or "could" be included, that particular component, feature, structure, or characteristic is not required to be included.

Where applicable, although state diagrams, flow diagrams or both may be used to describe embodiments, the invention is not limited to those diagrams or to the corresponding descriptions. For example, flow need not move through each illustrated box or state, or in exactly the same order as illustrated and described.

Methods of the present invention may be implemented by performing or completing manually, automatically, or a combination thereof, selected steps or tasks.

The term "method" may refer to manners, means, techniques and procedures for accomplishing a given task including, but not limited to, those manners, means, techniques and procedures either known to, or readily developed from known manners, means, techniques and procedures by practitioners of the art to which the invention belongs.

The descriptions, examples, methods and materials presented in the claims and the specification are not to be construed as limiting but rather as illustrative only.

Meanings of technical and scientific terms used herein are to be commonly understood as by one of ordinary skill in the art to which the invention belongs, unless otherwise defined.

The present invention may be implemented in the testing or practice with methods and materials equivalent or similar to those described herein.

Any publications, including patents, patent applications and articles, referenced or mentioned in this specification are herein incorporated in their entirety into the specification, to the same extent as if each individual publication was specifically and individually indicated to be incorporated herein. In addition, citation or identification of any reference in the description of some embodiments of the invention shall not be construed as an admission that such reference is available as prior art to the present invention.

While the invention has been described with respect to a limited number of embodiments, these should not be construed as limitations on the scope of the invention, but rather as exemplifications of some of the preferred embodiments. Other possible variations, modifications, and applications are also within the scope of the invention. Accordingly, the scope of the invention should not be limited by what has thus far been described, but by the appended claims and their legal equivalents.

What is claimed is:

1. A skin care device comprising:

a) a handle comprising:

a power source;

a user interface;

a base unit operatively associated with said power source and user interface, said base unit is arranged to create a rotating magnetic force by using a first magnet rotatable by a motor or via electromagnetic field induction, using electric power from the power source; and a transmission for transmitting power from said base unit to a head, said transmission is operatively connected to said base unit, and b) a head, watertight and detachably connected to the top surface of the base unit, comprising:

a disposable dispenser comprising a basis and a perforated sponge molded onto the basis wherein said sponge encloses therein therapeutic cream such that all the therapeutic cream is enclosed by said sponge;

at least one second magnet; and at least one ring shaped stator, second magnet is rotated by said created rotating magnetic force within the shaped stator which is further utilized as an energy source in the head unit, and wherein the disposable dispenser is arranged to release a specified portion of the therapeutic cream through the perforations of the perforated sponge onto a user's skin dependable upon the power transmitted to the basis.

2. The skin care device of claim 1, wherein said base unit comprises a top surface and a motor, said top surface comprises a projection that is connected to the motor and is arranged to be rotated thereby, wherein the transmission is arranged to transmit the rotations of the projection such as to periodically push the basis of the disposable dispenser, for releasing a specified portion of the therapeutic cream through the sponge perforations onto a user's skin by pressing of the sponge.

3. The skin care device of claim 1, wherein the power source is arranged to be inductively charged by a docking station.

4. The skin care device of claim 1, wherein the transmission is arranged to transmit power from the top surface of the base unit to the basis of the disposable dispenser inductively.

5. The skin care device of claim 1, wherein the transmission is arranged to transmit power from the top surface of the base unit to the basis of the disposable dispenser mechanically.

6. The skin care device of claim 1, wherein the transmission comprises an eccentric magnet rotatably mounted within a ring shaped stator, and wherein the rotation of the magnet generates an electric current within the ring shaped stator that is utilized as an energy source within the head.

7. The skin care device of claim 1, wherein said handle further comprises a controller and a transceiver and said head further comprises at least one radio frequency identification (RFID) tag associated with from said at least one RFID tag, and each said RFID tag is configured for storing information therein related to at least one functionality of said head for allowing said handle to control said head according to information retrieved from said at least one RFID tag, through the controller.

8. The skin care device of claim 7, wherein information that is stored on the at least one RFID tag is related to original heads only of the skin care device and allow usage of predefined parts of the skin care device only.

9. A skin care device comprising:

a) a handle comprising:

a power source;

a motor operated by said power source; and at least one first magnet configured for being rotated by said motor, and b) a head, watertight and detachably connected to the top surface of a base unit, comprising:

a disposable dispenser comprising a basis and a perforated sponge molded onto the basis wherein said sponge encloses therein therapeutic cream such that all the therapeutic cream is enclosed by said sponge;

at least one second magnet; and at least one ring shaped stator, wherein said second magnet is rotated by said first magnet and is configured to be utilized as an energy source of said head, and wherein the disposable dispenser is arranged to release a specified portion of the therapeutic cream through the perforations of the perforated sponge onto a user's skin dependable upon the power transmitted to the basis.

10. The skin care device of claim 9, wherein said at least one second magnet comprises two magnets one second magnet that is coaxially arranged in respect to the first magnet and another magnet that is eccentric to said first and second magnets, said eccentric magnet is utilized as an energy source of the head.

11. The skin care device of claim 1, wherein the second magnet further creates electric current or voltage.

* * * * *